United States Patent [19]

Schlosberg et al.

[11] 4,092,235

[45] May 30, 1978

[54] TREATMENT OF COAL BY ALKYLATION OR ACYLATION TO INCREASE LIQUID PRODUCTS FROM COAL LIQUEFACTION

[75] Inventors: Richard H. Schlosberg, New Providence, N.J.; Peter S. Maa; Richard C. Neavel, both of Baytown, Tex.

[73] Assignee: Exxon Research & Engineering Co., Linden, N.J.

[21] Appl. No.: 635,706

[22] Filed: Nov. 26, 1975

[51] Int. Cl.[2] ..... C10G 1/06

[52] U.S. Cl. ..... 208/8; 208/10

[58] Field of Search ..... 208/8, 9, 10

[56] References Cited

U.S. PATENT DOCUMENTS

| | | | |
|---|---|---|---|
| 2,133,280 | 10/1938 | Burk | 208/8 |
| 2,242,822 | 5/1941 | Fuchs et al. | 208/8 |
| 3,893,943 | 7/1975 | Willard | 208/8 |
| 3,926,575 | 12/1975 | Meyers | 208/8 |
| 4,033,852 | 7/1977 | Horowitz et al. | 208/8 |

OTHER PUBLICATIONS

Sternberg et al. *Fuel* vol. 50 (1971), pp. 432–442, Solubilization of an LVB Coal by Reductive Alkylation.

Hodek et al. *Fuel* vol. 52 (1973), pp. 220–225, Increase in Extractability of Bituminous Coals Caused by Acylation.

Sternberg et al. *Fuel* vol. 53 (1974), pp. 172–175, Solubilization of Coals by Reductive Alkylation.

*Primary Examiner*—Delbert E. Gantz

*Assistant Examiner*—James W. Hellwege

[57] ABSTRACT

The production of liquid hydrocarbons from coal is significantly enhanced by alkylating or acylating the coal prior to subjecting the coal to liquefaction conditions. The introduction of aliphatic hydrocarbon radicals or acyl radicals, including carbon monoxide, into the coal structure is believed to permit more of the coal to undergo liquefaction at suitable liquefaction conditions. The alkylation or acylation reactions can be conducted in the presence or absence of added or extraneous catalysts.

18 Claims, 1 Drawing Figure

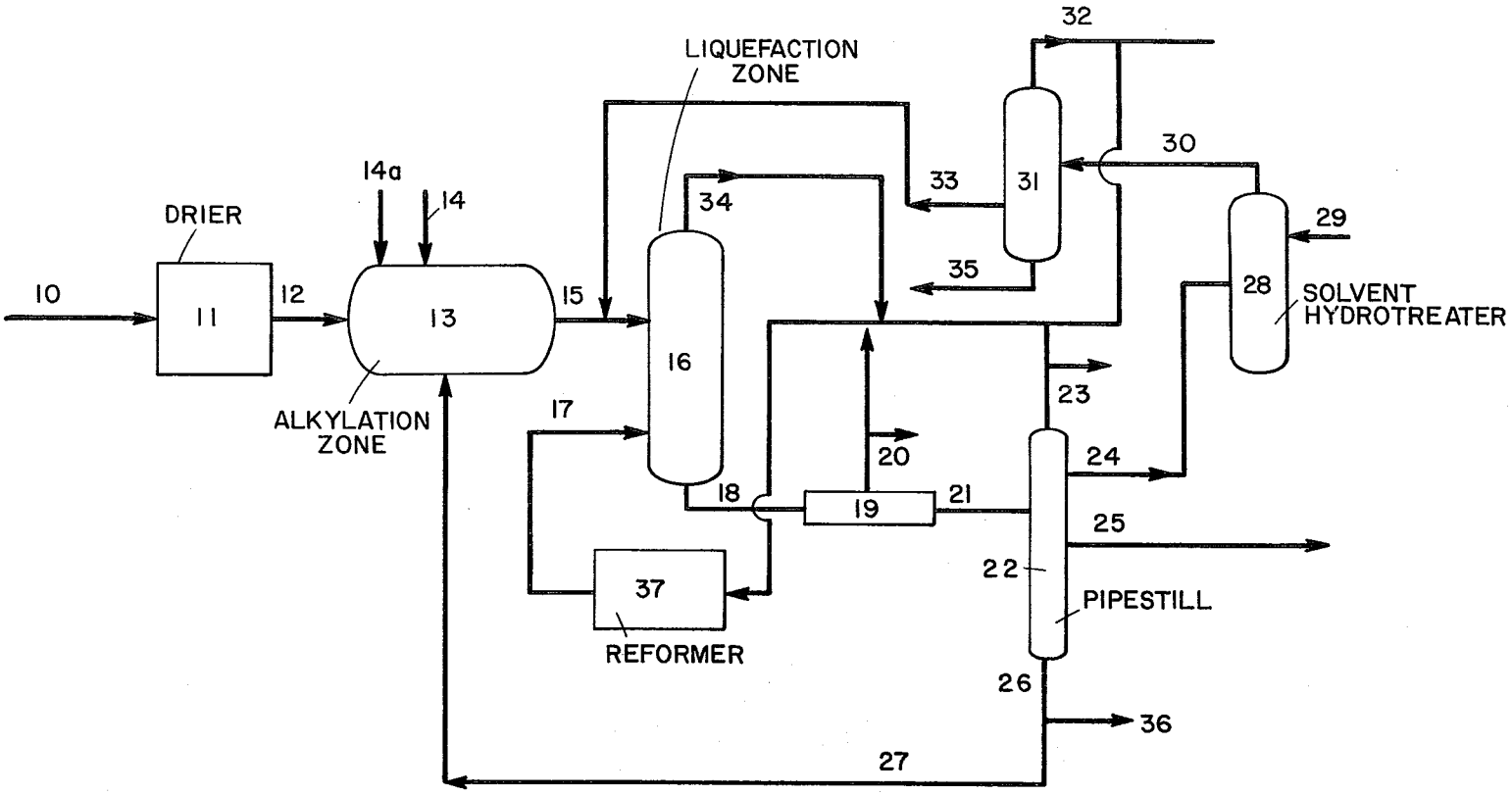
SOLVENT HYDROTREATER
PIPESTILL
LIQUEFACTION ZONE
REFORMER
ALKYLATION ZONE
DRIER
10
11
12
13
14
14a
15
16
17
18
19
20
21
22
23
24
25
26
27
28
29
30
31
32
33
34
35
36
37

TREATMENT OF COAL BY ALKYLATION OR ACYLATION TO INCREASE LIQUID PRODUCTS FROM COAL LIQUEFACTION

BACKGROUND OF THE INVENTION

1. Field of the Invention

This invention relates to an improved process for producing liquid hydrocarbons from coal. More particularly, this invention relates to a process for enhancing liquid hydrocarbon yields from solid coal by pretreating the coal to introduce aliphatic hydrocarbon radicals or acyl radicals (including carbon monoxide) into the coal structure. Still more particularly, in a preferred embodiment of this invention, the alkylated or acylated coal is subjected to liquefaction in the presence of hydrogen or a hydrogen donor solvent or both.

2. Discussion of the Prior Art

In recent years, the production of liquid hydrocarbons from non-petroleum sources has taken on added importance. Thus, with proven world petroleum reserves shrinking, other forms of energy have attracted attention. Perhaps, the greatest attention has been directed to coal, an abundant fossil fuel, particularly in the United States, which can be converted to liquid hydrocarbons at costs approaching current and projected costs for the refining of crude petroleum. Moreover, basic coal conversion technology exists and has been demonstrated on a variety of levels, e.g., pilot plant and full scale commercial (although highly expensive) plants. However, full development of existing conversion technology is only now under way.

Coking of coal with the attendant recovery of coal liquids is a long established process. Solvation of coal, with or without the addition of molecular hydrogen has also long been known as a feasible, if not economically attractive, process for producing coal liquids (see, for example, U.S. Pat. No. 1,342,790). The Pott-Broche Process (for example, U.S. Pat. No. 1,881,977) with modifications, was capable of producing gasoline from coal, albeit at then excessive costs. A number of process schemes for the liquefaction of coal using hydrogen donor solvents has also been suggested (for example, U.S. Pat. No. 3,617,513).

While there has been great emphasis on the conversion of coal to more useful liquid and gaseous products the investigation of the coal molecule, i.e., that which is to be converted, has often lagged and has been of relatively little importance. Nevertheless, an understanding of the material to be converted is elementary to the development of sound conversion technology. As a result, the chemistry of coal is now being actively pursued and while the structure of coal remains, for the most part, unresolved it is now generally believed that the coal molecule is not constructed on a diamond-like framework but rather it contains aromatic rings which are highly substituted (i.e., fused to other aromatics of hydroaromatics, or attached to alkyl, ether, hydroxyl, etc. groups). Additionally, it is now believed that coal exhibits secondary structural characteristics such as hydrogen bonding, interaromatic ring bonds, etc. which generate the three dimensional structure of coal. As a result of the condensed ring structure of coal, liquefaction processes have generally been limited by their ability to solvate exposed areas of the coal molecule. Thus, under normal liquefaction conditions, the secondary structural characteristics of the coal molecule are only partially, if at all, destroyed and a significant portion of the coal is not converted in the liquefaction process.

It has now been found that these secondary structural characteristics can be broken down, that is, the polymeric, three dimensional network structure of the coal is broken down by a non-destructive alteration of the coal molecule. Thus, the introduction of alkyl or acyl radicals into the coal molecule tends to increase the availability of reaction sites. In other, more simple, terms, more of the carbon in the coal is now susceptible to conversion at liquefaction conditions than would not have been available if the coal had not been alkylated or acylated.

Coal has been alkylated, primarily for investigation of the coal molecule. See, for example, C. Kroger, *Forshungs Ber. Nordrhein-Westfalen* No. 1488 (1965); H. W. Sternberg and C. L. Delle Donne, *Fuel,* 43, 172 (1974); H. W. Sternberg, C. L. Delle Donne, P. Pantages, E. C. Moroni and R. E. Markby, *Fuel,* 50, 432 (1971); J. D. Spencer and B. Linville, *Bureau of Mines Energy Program,* 1971, Bureau of Mines 1C8551, 1972; B. Linville and J. D. Spencer, *Review of Bureau of Mines Energy Program,* 1970, Bureau of Mines 1C8526, 1971; W. Hodek, and G. Kolling, *Fuel,* 52, 220 (1973) discussing the increase in extractability of bituminous coal by the related Friedel-Crafts acylation. Nevertheless, no prior reference has suggested that increased yields of liquid products via liquefaction can be obtained by first subjecting the coal to either alkylation or acylation. See, also, F. Meyer, Ph.D. Thesis, University of Munster, 1969; J. D. Spencer, *Review of Bureau of Mines Coal Program,* 1968, Bureau of Mines, 1C8416, 1969; J. D. Spencer, *Review of Bureau of Mines Coal Program,* 1969, Bureau of Mines, 1C8385, 1968, Sternberg, H. W. et al, The Electrochemical Reduction of a Low Volatile Bituminous Material, *Fuel,* 45 (6) 409–482 (1966). In "Coal Liquefaction by Alkylation Techniques," D. D. Denson and D. W. Buckhouse in a Stanford Research Institute paper dated 20 June 1975 prepared under a National Science Foundation grant, alkylation was utilized to enhance solvent refining but, again, no mention was made of enhancing liquid product yields by alkylation/acylation followed by convertiang the coal under liquefaction conditions.

SUMMARY OF THE INVENTION

Now, in accordance with the invention, it has been discovered that the production of liquid hydrocarbons from coal via coal liquefaction can be increased when the coal is initially subjected to alkylation or acylation prior to liquefaction. That is, the coal can be treated under normal and well known liquefaction conditions subsequent to the introduction of aliphatic hydrocarbon radicals (alkylation) or acyl radicals (acylation) into the coal structure. The pre-liquefaction reactions can be exemplified by the following equation:

(1) alkylation

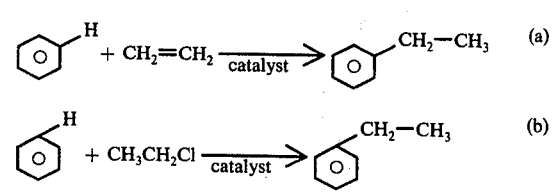

(2) acylation

-continued

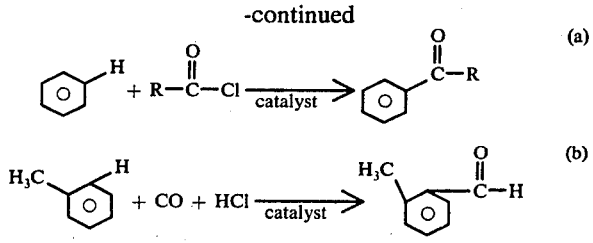

Thus, equation (1) represents olefin alkylation of an aromatic ring that might be present in the coal molecule and equation (2) similarly represents the acylation of the aromatic ring. It should be noted that for the purposes of this specification, acylation includes the reaction of HCl and Co, in the presence of a Friedel-Crafts catalyst to synthesize aldehydes, i.e., formylation. This reaction is commonly known as the Gatterman-Kach reaction in which a CO group is introduced into aromatic molecules under the influence of a Friedel-Crafts catalyst, usually aluminum chloride or aluminum bromide. See, for example, Friedel-Crafts and Related Reactions, J. Wiley & Sons Inc. (1964) Edited by G. A. Olah, pps 1154–1177.

While not wishing to be bound by theoretical considerations, it is believed that the size of the alkylating or acylating agent is an important consideration. Thus, it is believed that, in general, the bulkier the attached agent the better will be the results upon subsequent liquefaction. Consequently, branched or cyclic compounds are preferred to straight chain compounds having the same number of carbon atoms. Since the macromolecular coal structure is believed to be opened up by these compounds, the bulkier the radical the greater its effect in producing available sites for liquefaction. In the same vein, it is desirable to introduce as many of these radicals into the coal structure as technology and economics allow. Therefore, in a preferred embodiment the coal feed may be subjected to multiple alkylation or acylation cycles to increase the number of radicals introduced into the coal structure.

In another preferred embodiment, the alkylated or acylated coal is liquefied in the presence of hydrogen or a hydrogen donor solvent or both. It should be understood, however, that the advantageous results achieved through the alkylation or acylation of coal can be realized with any liquefaction system, some of which will be described hereinbelow. Nevertheless, it is preferred to employ solvent hydrogen donor liquefaction and to operate a hydrogen donor solvent liquefaction zone at temperatures of about 650° F to about 1000° F, preferably about 700° to 900° F, pressures of about 100 to about 3000 psig, preferably about 1250 to 2000 psig, and a solvent/coal weight ratio of from 0.5/1 to 4/1, preferably about 1/1 to 2/1.

DESCRIPTION OF THE DRAWING

FIG. 1 schematically shows one method for effecting this invention.

DETAILED DESCRIPTION

The products of the liquefaction process are normally light gases, liquid products and a bottoms fraction of unconverted coal and ash. On the basis of the invention, the unconverted coal remaining after liquefaction can be considered as coal that is not susceptible to liquefaction because the material is so refractory, that is, the secondary structural characteristics caused parts of the structure to be inaccessible or of limited accessibility to initial alkylation of the raw coal. Consequently, it is an embodiment of this invention to recycle all or a portion of the remaining solid residue from the liquefaction zone to the alkylation zone. Separation of the solids material can be carried out by any known means, e.g., filtration, vacuum distillation, centrifugation, hydroclones, etc., preferably by vacuum distillation.

Alkylation and acylation can be broadly characterized as electrophilic substitution reactions. More particularly, the alkylation or acylation of coal can be characterized as an electrophilic substitution wherein the aromatic carbon-hydrogen bond, e.g., aromatic C-H of the coal molecule, is the site of primary attack by the alkylating or acylating agent.

Alkylation and acylation are well known and well documented reactions. The use of coal as the material to be alkylated or acylated does not change the chemistry of the reaction or the manner in which the reaction proceeds. Consequently, coal can be alkylated or acylated at conditions amenable to alkylation or acylation of many other materials, particularly those of an aromatic nature. Nevertheless, the coal should be in a finely ground state, further elaborated upon hereinbelow, to facilitate contact with the alkylating or acylating reagent which may be either a liquid or a gas at reaction conditions. Generally, any compound capable of being an acylating agent or an alkylating agent can be employed.

In the case of acylation, the reagent may be any compound containing an acyl group, that is,

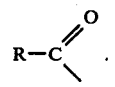

Thus, acyl halides, e.g., iodide, bromide, chloride, or fluoride, can be employed as well as,
phosgene, and compounds generally of the formula

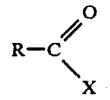

wherein X may be a halogen (i.e., iodine, bromine, chlorine, fluorine),

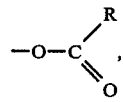

(as in an anhydride), and R may be alkyl, cycloalkyl, aryl cycloalkyl, or arylalkyl. The number of carbon atoms in the acyl containing compound can vary widely, such as $C_2$ or larger, preferably $C_2$ to $C_{20}$. Examples of acyl containing compounds are acetyl chloride, lauroyl chloride, benzoyl chloride, etc. Additionally, carbon monoxide, although not an acyl compound, per se, can be employed, as previously mentioned, in the formylation reaction.

In the case of alkylation, the reagent can be olefinic, paraffinic, cycloparaffinic, or an alkyl halide. The size of the reagent is not critical although the larger the chain the more benefit per reaction site insofar as subsequent conversion of the coal via liquefaction is concerned. Preferably $C_2$–$C_{20}$ olefins are employed, $C_2$–$C_{20}$ paraffins, and compounds having the general formula $R_2$-X wherein X is any halogen and $R_2$ can be alkyl, cycloalkyl, aryl cycloalkyl, or arylalkyl and more preferably having from 1–20 carbon atoms. Still more preferably are $C_2$–$C_8$ alkyl halides and $C_2$–$C_8$ olefins, e.g., ethylene, propylene, butylene, pentylene, butyl chloride, propyl bromide, ethyl chloride, ethyl iodide, etc.

Alcohols can also be employed as alkylating agents although a greater than stoichiometric amount of catalyst is usually required when an alcohol is the alkylating reagent. $C_1$–$C_{20}$ straight chain or branched compounds can be employed. Thus, in the formula $R_2$-X, X can also be an OH (hydroxyl) group.

The use of acyl halides or alkyl halides requires the use of an acid catalyst to promote the desired reaction. Catalysts that can be employed are broadly characterized as electron acceptors and may be commonly referred to as Friedel-Crafts catalysts. Examples of such catalysts are as follows. (1) Acidic halides such as Lewis acids, typified by metal halides of the formula $MX_n$ wherein M is metal selected from Groups IIB, IIIB, IVA, IVB, VB, VIB, or VIII of the Periodic Chart of the Elements, X is a halide from Group VIIA, and n is an integer from 2 to 6. Further examples of these materials are the fluorides, chlorides, or bromides, preferably fluorides, chlorides or bromides of aluminum, beryllium, cadmium, zinc, boron, gallium, titanium, zirconium, tin, lead, bismuth, iron, uranium, molybdenum, tungsten, tantalum, niobium, etc. Preferably, preferred materials are aluminum chloride, aluminum bromide, zinc chloride, ferric chloride, antimony pentafluoride, tantalum pentafluoride, boron trifluoride, etc. Additionally, these materials may be promoted with co-catalysts that are proton releasing substances, e.g., hydrogen halides, such as hydrogen chloride. Thus, a particularly preferred catalyst is HCl or $AlCl_3$/HCl. (2) Metal alkyls and halides of aluminum, boron, or zinc, e.g., triethyl aluminum, diethyl aluminum halide, and the like. (3) Protonic acids commonly referred to as Bronsted acids and typified by sulfuric acid, hydrofluoric acid, hydrochloric acid, hydrobromic acid, fluorosulfuric acid, phosphoric acid, alkane sulfonic acids, e.g., trimethane sulfonic acid, trifluoroacetic acid, aromatic sulfonic acids such as para-toluene sulfonic acid, and the like, preferably HF or HCl. (4) Acidic oxides and sulfides (acidic chalcides) and modified zeolites, e.g., $SiO_2/Al_2O_3$. Additionally, these materials may be promoted with co-catalysts that are proton releasing substances, e.g., hydrogen halides such as hydrogen chloride and hydrogen fluoride. Since eastern and western American sub-bituminous coals, bituminous coals, and lignite contain significant amounts (as much as 7% by weight) of clays and acidic oxides, the use of clays and acidic oxides either by promotion with acids (e.g., HCl, HF) or alone is particularly preferred. (5) Cation exchange resins. (6) Metathetic cation forming agents. Preferred catalysts are Lewis acids, Bronsted acids and acidic oxides.

When the metal halides are employed normal precautions should be taken to avoid preferential reaction and consequently catalyst deactivation, by combination with water. Thus, the coal is normally dried and should be substantially moisture free, that is, less than 4 wt. % moisture, based on coal, preferably less than 2 wt. % moisture. Alternatively, the acyl halide or alkyl halide can be mixed with the metal halide catalyst prior to contacting with the coal and thereby inhibit any deactivation of the metal halide catalyst due to reaction with water.

The metal halide can be utilized in any desired amount, e.g., catalytic amounts, based on the acylating agent. Thus, about 100 to 150 mol % metal halide, preferably 100 to 120 mol %, and more preferably 100 to 105 mol % metal halide can be employed.

Acylation conditions are not critical and temperatures may range from about −20° to 200° C, preferably 0° to 150° C, while pressures may range from 0 to 2000 psig, preferably atmospheric to 1500 psig. Contact times may also vary widely, e.g., a few seconds to several hours, preferably about 10 seconds to 60 minutes.

Alkylation is similarly accomplished by the use of known techniques. Thus, alkylation of the coal can be effected either with or without the addition of an extraneous catalyst. Normally, alkylation is effected either catalytically or thermally. However, in the case of coal, it is believed that the mineral matter present in coal may also act as a catalyst for alkylation.

Again, moisture should be avoided and the presence of water should be kept below the amounts mentioned above. Additionally, when olefins are employed, care should be taken to avoid conditions that could lead to olefin polymerization, e.g., lower temperatures. Preferably $C_2$ and terminal olefins are used and preferred catalysts are HF, $BF_3$, phosphoric acid, or acid promoted coal mineral matter or no extraneous catalyst. Generally, however, temperatures may range from about 0° to 300° C, preferably 25° to 250° C with pressures ranging from about 0 to 2000 psig, preferably 0 to 1500 psig and contact times again ranging from a few seconds to several hours, preferably about 10 seconds to about 60 minutes. When no extraneous catalyst is employed, temperatures should be raised within the ranges shown to facilitate the process.

A variety of alkylation catalysts can be employed and these can be known and reported catalysts such as the Friedel-Crafts catalysts mentioned above, particularly the Lewis acids, or strong acids such as hydrofluoric acid, hydrochloric acid, sulfuric acid, fluorosulfuric acid, trifluoracetic acid, methane sulfonic acid, and the like as well as mixtures of Lewis acids with Bronsted acids for example as shown in the U.S. Pat. No. 3,708,583. The amount of catalyst, if any, employed can range from 0.05 to 50 wt. % based on coal, preferably 0.05 to 10 wt. %.

At the conclusion of the alkylation or acylation reaction, the activated coal is separated from the reaction mixture by conventional techniques and made free of any acid catalyst, as by washing. As mentioned above, the alkylation or acylation step can then be repeated to maximize the amount of reagent taken up by the coal and to reduce, insofar as possible, the presence of secondary structural characteristics in the coal.

Generally, any type of coal can be utilized in the process of this invention, such as bituminous, subbituminous, lignite, etc., preferably bituminous or subbituminous, the coal is generally ground to a finely divided state and will contain particles less than about ¼ inch in size, preferably less than about 8 mesh NBS seive size, more preferably less than about 100 mesh. It is believed that the degree of radical take-up by the coal may be a function of coal surface area. Consequently, it is desirable to expose as much coal surface area as possible without losing coal as dust or fines or as the economics of coal grinding may dictate. Thus, particle sizes of less than about 8 mesh NBS seive size to greater than about 325 mesh are preferred and particle sizes of less than about 100 mesh to greater than about 325 mesh are more preferred. The coal can be dried by conventional drying techniques, for example, by heating to about 100° to 110° C, but below temperatures that might cause other reactions when susceptible coals are employed. The dried coal can then be fed to the alkylation or acylation zone either as a solid or slurried in a suitable solvent, e.g., paraffins such as heptane, hexane, cyclohexane, carbon disulfide, halogenated paraffins such as carbon tetrachloride, $CHCl_3$, etc., although a solid feed is preferred since solvents tend to reduce the activity of catalysts employed in alkylation or acylation.

Subsequent to the alkylation/acylation reaction, the product, hereafter referred to as "activated coal," is subjected to liquefaction. Various types of liquefaction can be employed such as solvent refining, as exemplified by the PAMCO process developed by the Pittsburg and Midway Coal Co., direct hydrogenation with or without a catalyst, catalytic or noncatalytic hydrogenation in the presence of a non-donor solvent, catalytic or non-catalytic liquefaction by the donor solvent method, the latter being preferred particularly with the presence of hydrogen during the liquefaction step. One solvent hydrogen donor liquefaction process is described in U.S. Pat. No. 3,617,513. As used in this specification, liquefaction means the conversion of coal as distinguished from mere solvent extraction where essentially no conversion takes place, e.g., extraction with solvents such as benzene, pyridine or tetrahydrofurane at room temperature or temperatures ranging up to the boiling point of the extractive solvent. Thus, substantial chemical reaction does not occur until temperatures are raised above about 150° C, preferably above about 200° C. Liquefaction, as opposed to solvent extraction, utilizes a vehicle rather than an extractive solvent and is a more severe operation, maximizes light liquid yields, and involves substantial chemical reaction of the coal. Solvent extraction tends to maximize heavier liquid yields, e.g., fuel oil and higher boiling constituents while involving little or no chemical reaction due to the temperatures involved, e.g., less than 200° C, preferably less than 150° C, still more preferably less than 115° C. Additionally, maximizing light liquid yields allows for separation of the bottoms by distillation, e.g. vacuum distillation, rather than by filtration which is used for solvent refined coals.

Briefly, however, hydrogen donor solvent liquefaction utilizes a hydrogen donating solvent which is composed of one or more donor compounds such as indane, $C_{10}$–$C_{12}$ tetralins, $C_{12}$–$C_{13}$ acenaphthenes, di-, tetra-, and octahydroanthracenes and tetrahydroacenaphthene as well as other derivatives of partially saturated hydroaromatic compounds. The donor solvent can be the product of a coal liquefaction process and can be a wide boiling hydrocarbon fraction, for example, boiling in the range of about 300°–900° F, preferably about 375° F to 800° F. The boiling range is not critical except insofar as a substantial portion of the hydrogen donor molecules are retained in the liquid phase under liquefaction conditions. Preferably, the solvent contains at least about 30 wt. %, more preferably at least about 50 wt. %, based on solvent, of compounds which are known hydrogen donors under liquefaction conditions. Thus, the solvent is normally comprised of donor and non-donor compounds.

Since the donor solvent can be obtained by hydrogenating coal liquids derived from liquefaction, for example, the composition of the hydrogen donor solvent will vary depending upon the source of the coal feed, the liquefaction system and its operating conditions and solvent hydrogenation conditions. A typical inspection of a hydrogenated liquefaction recycle stream useful as a donor solvent is shown in Table II of U.S. Pat. No. 3,617,513, said table being incorporated herein by reference.

The coal can be slurried in the hydrogen donor solvent and passed to a liquefaction zone wherein the convertible portion of the coal is allowed to disperse or react. Activation of the coal by alkylation or acylation is believed to make more of the coal convertible, as compared to a non-alkylated or non-acylated coal.

The solvent/coal ratio, when about 50 wt. % of the solvent is hydrogen donor type compounds, can range from about 0.5:1 to 4:1, preferably about 1:1 to 2:1. Preferably the donor solvent contains at least about 25% hydrogen donor compounds, more preferably at least about 33% hydrogen donor compounds. Operating conditions can vary widely, that is, temperatures of about 600° to 1000° F, preferably about 750° to 900° F; pressures of about 300 to 3000 psig, preferably about 1000 to 2500 psig; residence times of about 5 minutes to 200 minutes; and molecular hydrogen input of about 0 to 4 wt. % (based on m.a.f. coal charged to the liquefaction zone in the slurry). The primary products removed from the liquefaction zone are light gases, liquid products and a slurry of unconverted coal and ash in heavy oil. Since the liquid state products contain the donor solvent in a hydrogen depleted form the liquid can be fractionated to recover an appropriate boiling range fraction which can then be hydrogenated and returned to the liquefaction zone as recycle, hydrogenated donor solvent.

Recycle solvent, preferably boiling in the range of about 350° to 800° F, separated from the liquid product of the liquefaction zone, can be hydrogenated with hydrogen in the presence of a suitable hydrogenation catalyst. Hydrogenation temperatures can range from about 650° to 850° F, pressures can range from about 650 to 2000 psig, space velocities of 1 to 6 weights of liquid per hour per weight of catalyst can be employed. A variety of hydrogenation catalysts can be employed such as those containing components from Group VIB and Group VIII, e.g., cobalt molybdate on a suitable support such as alumina, silica, titania, etc. The hydrogenated product is then fractionated to the desired boiling range and recycled to the liquefaction zone or slurried with the coal prior to the liquefaction zone.

Referring now to the drawing, coal from storage is crushed and ground to less than about 8 mesh and fed by line 10 into driver 11 wherein substantially all the moisture is removed from the ground coal. Drying temperatures should be controlled so as to minimize caking (when caking coals are employed) and to prevent further polymerization of coal molecules. Drying temperatures of about 100 to 110° C. for about 0.5 to 4 hours can be employed. Dried coal in line 12 is introduced into alkylation zone 13 and an alkylating agent, e.g., isopropyl chloride is introduced via line 14. A suitable catalyst such as aluminum chloride is introduced in line **14*a***.

It is understood that alkylation zone 13 can be one or more alkylation reactors, interspersed by washing steps, into each of which fresh alkylating agent and catalyst is introduced. Additionally, unreacted coal recovered from the liquefaction process can be recycled via line 27 for further treatment in the alkylation zone. Alkylated coal substantially free of catalyst and dried (by equipment not shown) is mixed with recycle solvent from line 33 to form a solvent/coal slurry in line 15 and fed to liquefaction zone 16 operating at a temperature of about 840° F and 1500 psig. Hydrogen is fed to the liquefaction zone through line 17. A preheat heat furnace (not shown) is often desirable to heat the slurry to reaction temperatures for liquefaction.

Light gases, such as CO, $CO_2$, $H_2S$ and light hydrocarbons are removed from the liquefaction zone by line 34 and the liquid product, in a slurry with unconverted coal, is recovered in line 18 and flashed in drum 19 to reduce the pressure, light gases and light hydrocarbons being flashed off in line 20 and an oil/coal slurry being recovered in line 21. The light hydrocarbons from line 34 can be treated by conventional means to remove $CO_2$ and $H_2S$ and then sent to a conventional steam reforming furnace wherein the hydrocarbon gases are reformed to produce hydrogen for use in the process, such as in line 17 (and line 29). The reformer, 37, can also be used to handle off gases from the pipestill 22 (line 23) and fractionator 31 (line 32). The product of line 21 is then treated in a fractionator 22 which can be an atmospheric or vacuum pipestill or both. Light gases are removed overhead in line 22 while a recycle solvent stream is removed via line 24 for treatment in solvent hydrotreater 28. Liquid product for upgrading by, e.g., catalytic cracking, is recovered in line 25. A product containing the residuum and unconverted coal is taken off by line 26, a portion of which can be recycled via line 27 to the alkylation zone, or treated in a separate alkylation zone and then recombined with the feed to the liquefaction zone. In a balanced process some or all of the bottoms can be sent to hydrogen manufacture via line 36 to make hydrogen for use in the liquefaction zone and the solvent hydrotreater.

Recycle solvent is catalytically hydrogenated in hydrotreater 28, hydrogen being supplied in line 29, over a catalyst such as cobalt molybdate on an alumina support. Hydrotreated product is recovered in line 30 and fractionated in fractionator 31 from which recycle hydrogen donor solvent of the desired boiling range is recovered in line 33 and recycled to line 15 to slurry alkylated coal. Additional liquid product is recovered in line 35 and may be subjected to further upgrading. Any light gases formed during hydrotreating can be removed via line 32.

EXAMPLES 1-6

The following examples illustrate the process described hereinabove. Liquefaction tests were conducted in a tubing bomb (a batch liquefaction reactor) using tetralin as the hydrogen donor solvent. Liquefaction was conducted at 800° F for 130 minutes residence time, with and without the addition of hydrogen gas. Solids residue was measured as cyclohexane insoluble and weight percents are based on dry coal.

The alkylated coals were prepared in the following manner:

SAMPLE A

This was a doubly alkylated and benzene extracted coal sample. Twenty-eight gms. of the Illinois #6 coal (<100 mesh) and 6 gms. of aluminum chloride ($AlCl_3$) were mixed and chilled to 0° C in an autoclave with 125 ml capacity. Forty-one gms. of isopropyl chloride [$(CH_3)_2CHCl$] was then added to the vessel. The autoclave was heated to 100° C and maintained at that temperature for 2 hours. The final pressure reading was 420 psig. After venting the gas and cooling to room temperature, the pressure reading was 270 psig. After venting the gas, the resulting slurry was first washed with water to remove aluminum chloride and then extracted with 300 ml. benzene at 75° C for 10 minutes. The precipitate was filtered and mixed with 6 gms. of aluminum chloride and chilled to 0° C again. Fifty gms. of isopropyl chloride [$(CH_3)_2CHCl$] was added to the vessel. It was then heated to 150° C and maintained at that temperature for 5 hours. The final pressure was 340 psig. It was then cooled overnight to room temperature. The pressure reading was 80 psig. The slurry was washed with water to remove aluminum chloride and then extracted with 300 ml. of benzene at 75° C for 2 hours. The solid residue was then filtered and vacuum dried.

SAMPLE B

This was a singly alkylated and benzene extracted coal sample. Fifteen gms. of Illinois #6 coal and 3 gms. of aluminum chloride ($AlCl_3$) were mixed and chilled to 0° C in an autoclave with 125 ml. capacity. Ten gms. of isopropyl chloride [$(CH_3)_2CHCl$] was then added to the vessel. The autoclave was heated to 100° C and maintained at that temperature for 2 hours. After venting the gas, the resulting slurry was first washed with water to remove aluminum chloride and then extracted with benzene at solid-to-benzene ratio of about 3 to 100 at 78° C for 4 hours. The solid residue was then filtered and vacuum dried.

SAMPLE C

This was a singly alkylated coal sample. This sample was prepared by the method similar to sample B except no benzene extraction was performed. Elemental analyses of the alkylated coal are shown in Table I and compared to the raw coal.

Table I

Elemental Analyses of Alkylated Coals and Raw Coal (wt. % based on coal)

| Sample No. | A | B | C | Illinois #6 raw coal |
|---|---|---|---|---|
| $H_2O$ | 2.66 | 4.37 | 2.78 | 2.60 |
| Ash (dry) | 9.53 | 8.82 | 9.17 | 8.65 |
| C | — | 71.63 | 69.68 | 70.64 |
| H | — | 4.93 | 5.18 | 4.94 |
| O | — | 10.07 | 11.18 | 10.52 |
| S | — | 3.62 | 3.56 | 4.08 |
| N | — | 0.92 | 1.23 | 1.17 |
| Al | 0.125 | 0.200 | 0.113 | — |
| Cl | 0.776 | 0.785 | 0.727 | 0.09 |
| Atomic H/C | 1.04 | 0.826 | 0.892 | 0.839 |
| Benzene Extraction | 9.25 | 1.93 | — | — |

Table II below summarizes the results of the liquefaction process.

Table II

| Example No. | 1 | 2 | 3 | 4 | 5 | 6 |
|---|---|---|---|---|---|---|
| Solvent | tetralin | tetralin | tetralin | tetralin | tetralin | tetralin |
| Solid | raw coal | A | B | C | B | C |
| Solvent/coal ratio | 4/1 | 4/1 | 4/1 | 4/1 | 4/1 | 4/1 |

Table II-continued

| Example No. | 1 | 2 | 3 | 4 | 5 | 6 |
|---|---|---|---|---|---|---|
| $H_2$Gas | no | no | no | no | 2.30 wt.% | 2.30 wt.% |
| Pressure (psig) | 1640 | 2100 | 3000 | 3000 | 1460 | 1260 |
| Temperature (° F) | 800 | 800 | 800 | 800 | 770 | 770 |
| Residence time (min) | 130 | 130 | 130 | 130 | 130 | 130 |
| % Solid residue | 30.09 | 22.00 | 30.25 | 31.87 | 23.36 | 25.68 |
| % Gas make | 5.31 | 5.39 | 3.49 | 3.70 | 6.19 | 5.60 |
| $H_2$ | 0.45 | 0.57 | 0.50 | 0.51 | — | — |
| $CO_x$ | 1.31 | 1.35 | 0.87 | 0.86 | 1.03 | 0.96 |
| $H_2S$ | 0.21 | 0. | 0. | 0. | 0. | 0. |
| $C_1$ - $C_3$ | 3.08 | 3.36 | 2.03 | 2.23 | 1.98 | 2.30 |
| $C_4$- $C_8$ | 0.13 | 0.06 | 0.09 | 0.10 | 3.18 | 2.34 |
| % $H_2$ Consumption | — | — | — | — | 0.14 | 0.43 |
| %$H_2O$ Make | 10.97 | 9.00 | 5.38 | 6.91 | 5.38* | 6.91* |
| % Liquid Make | 53.63 | 63.61 | 60.88 | 57.52 | 65.21 | 62.24 |
| % S in liquid | 0.26 | 0.11 | 0.14 | 0.16 | 0.12 | 0.13 |
| % N in liquid | 0.23 | 0.14 | 0.14 | 0.11 | — | — |

*The water was not measured and the data from the run without hydrogen gas was used.

The results of Table II show that liquid yield is increased when alkylated coal is liquefied as opposed to liquefaction of a raw, non-alkylated coal and that the best liquid yields are obtained with a coal that has been alkylated twice, sample A. Additionally, the presence of hydrogen gas decreases the solid residua and increases $C_4$ – $C_8$ product make. Unexpectedly, the sulfur concentration of the gas and liquid products of liquefied, alkylated coals is sharply decreased as compared to a non-alkylated coal.

The liquefaction experiments are run in a batch reactor. The reactor is immersed in a sand bath and temperature control from room temperature to ~1000° F is attainable. Mixing is obtained via the holding rod moving 2 inches up and down in a reciprocal motion. Gases are introduced through the holding rod via a gas distributor. The reactants are charged to the empty vessel and after appropriate weighings the vessel is connected to the system and heated to reaction temperature. After the appropriate residence time, the reactor is cooled, the appropriate analyses are made, and the solubility is determined.

EXAMPLE 7

This example is meant to show the method of alkylation and that the aromatic sites of coal are readily alkylated. The Illinois #6 coal was analyzed to determine its average composition, which was found to be as shown in Table III (dry basis).

Table III

| | |
|---|---|
| Carbon | 70.64% |
| Hydrogen | 4.94% |
| Total oxygen (by difference) | 10.52% |
| Nitrogen | 1.17% |
| Total Sulfur | 4.08% |
| Pyritic Sulfur | 0.97% |
| Ash | 8.65% |
| Heating value, BTU/lb. | 12850 |

Fifteen grams of the above mentioned coal and 3 g. of $AlCl_3$ were mixed and chilled to 0° C in an autoclave with 125 ml. capacity. Fifteen ml. of isopropyl chloride [$(CH_3)_2CHCl$] was then added to the vessel. The autoclave was heated to 100° C and maintained at that temperature for 2 hours. After venting the gas, the resulting slurry was first washed with water to remove aluminum chloride and then extracted with benzene at solid-to-benzene ratio of about 3 to 100 at 78° C for 4 hours. The solid residue was filtered, vacuum dried, and was then analyzed for its carbon and hydrogen contents. Table IV summarizes the four experimental runs with various alkylating agents and catalysts by use of the same experimental procedure.

Table IV

| Coal + Alkylating Agent | | | | Alkylated Coal | |
|---|---|---|---|---|---|
| HC | | Catalyst → | Extraction → | H/C | ash |
| 0.84 | $(CH_3)_2CHCl$ | $AlCl_3$ | Benzene | 1.01 | — |
| 0.84 | $CH_3CH{=}CH_2$ | HCl | Benzene | 0.92 | — |
| 0.84 | $CH_2{=}CH_2$ | HCl | Benzene | 1.01 | — |
| 0.84 | $(CH_3)_2CHCl$ | $AlCl_3$ | Benzene | 1.04 | 9.53 |

EXAMPLE 8

This example is meant to show that the alkylated coal residue is susceptible to liquefaction and results in a low solid residue and a high liquefaction yield. The alkylated coal residue prepared in Example 7 by use of isopropyl chloride as alkylating agent and aluminum chloride as catalyst gave a H/C ratio of 1.04 and ash content of 9.53 wt. %. About 10% of alkylated coal was extracted with benzene. The dried, powdered alkylation coal residue was mixed with tetralin at 4 to 1 of tetralin to alkylated coal ratio and then was charged to a 30 cc. tubing bomb. The liquefaction reaction was carried out at 800° F for 2 hours and with an agitation rate of 100 cycle/minute. The pressure was maintained below 2000 psig. The material balance of the run is shown in Table V. The percent is based on the weight percent of the alkylated coal residue.

Table V

| | |
|---|---|
| % residue | 22.00 |
| % $H_2O$ | 9.00 |
| % gas make | 5.39 |
| % liquid yield | 63.61 |
| Composition of gas | |
| $H_2$ | 0.57 |
| $CO_x$ | 1.35 |
| $H_2S$ | — |
| $C_1$ - $C_3$ | 3.36 |
| $C_4$ - $C_8$ | 0.06 |

EXAMPLE 9

This example is meant to show the product distribution of Illinois No. 6 coal reacted with tetralin. The Illinois #6 coal having the same analysis as in Example 7 was mixed with tetralin at 4 to 1 of tetralin to coal ratio and was then charged into a 30 cc. tubing bomb. The liquefaction reaction was carried out at 800° F for 2 hours and with an agitation rate of 100 cycle/minute. The pressure was maintained below 2000 psig. The material balance of the run is shown in Table VI. The percent is the weight percent based on the dry coal.

Table VI

| | |
|---|---|
| % residue | 30.09 |
| % $H_2O$ | 10.97 |
| % gas make | 5.31 |
| % liquid yield | 53.63 |
| Composition of gas | |
| $H_2$ | 0.45 |
| $CO_x$ | 1.31 |
| $H_2S$ | 0.21 |
| $C_1$ - $C_3$ | 3.08 |
| $C_4$ - $C_8$ | 0.13 |

The comparison of Table V and Table VI shows that the alkylated coal produced about 10% less solid residue and 10% more liquid as comparing with raw coal.

In another embodiment of this invention, olefins or alkyl halides useful as alkylating agents can be prepared from the $C_1$–$C_3$ off gases from the liquefaction zone, as shown above in Table VI. While these light gases will generally be saturated, they can be cracked by conventional and known techniques, e.g., steam cracking, to produce $C_2$ and $C_3$ olefins. The olefins can be used as such or easily converted to alkyl halides by reaction with HCl.

What is claimed is:

1. A process for obtaining liquid hydrocarbons from coal which comprises treating the coal with a reagent selected from the group consisting of alkylating agents and acylating agents and thereby introducing into the coal a radical selected from the group consisting of aliphatic hydrocarbon radicals and acyl radicals respectively and thereafter liquefying at least a portion of the treated coal at temperatures ranging from 600°–1000° F. and pressures of 300–3000 psig in the presence of a hydrogen donor solvent and/or molecular hydrogen.

2. The process of claim 1 wherein liquefaction conditions include elevated temperatures and pressures and the presence of a hydrogen donor solvent boiling in the range of about 300° to about 950° F.

3. The process of claim 1 wherein the reagent is an acylating agent and is selected from the group consisting of carbon monoxide and hydrogen chloride, phosgene, and compounds having the formula

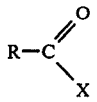

wherein R is an alkyl, cycloalkyl, arylcycloalkyl or arylalkyl radical and X is a halogen or anhydride derivative.

4. The process of claim 3 wherein the acylating agent is an acyl halide and acylation is effected in the presence of an added acylation catalyst.

5. The process of claim 3 wherein the acylating agent is carbon monoxide and hydrogen chloride and the reaction is effected in the presence of a hydrogen halide catalyst.

6. The process of claim 1 wherein the reagent is an alkylating agent and is selected from the group consisting of olefins, paraffins, and compounds having the formula $R_2$-X wherein X is a halogen or hydroxyl and $R_2$ is an alkyl, cycloalkyl, arylcycloalkyl or aryl alkyl radical.

7. The process of claim 6 wherein the alkylating agent has the formula $R_2$-X and the alkylation is effected in the presence of an added alkylation catalyst.

8. The process of claim 1 wherein the treatment of the coal with the reagent comprises the following steps:

(a) contacting the coal with the reagent for a period sufficient to cause the reagent to react with the coal;

(b) washing the treated coal to remove substantially all of the unreacted reagent;

(c) repeating steps (a) and (b).

9. The process of claim 2 wherein a bottoms fraction is recovered from the liquefaction step, the bottoms fraction comprising unliquefied coal and treating at least a portion of the bottoms fraction with the reagent and returning the treated bottoms fraction to the liquefaction step.

10. The process of claim 1 wherein a catalyst is employed during the treating step.

11. The process of claim 1 wherein a fraction containing unliquefied coal is recovered from the liquefaction step and is returned to the treating zone.

12. The process of claim 1 wherein the reagent is an acylating agent selected from the group consisting of carbon monoxide and hydrogen chloride, phosgene and compounds having the formula

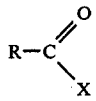

wherein R is a $C_2$14 $C_{20}$ alkyl, cycloalkyl, arylcycloalkyl, or aryl alkyl radical and X is a halogen or anhydride derivative.

13. The process of claim 12 wherein the acylating agent is carbon monoxide and hydrogen chloride and the reaction is effected in the presence of a catalyst containing hydrogen halide.

14. The process of claim 12 wherein the acylating agent is a $C_2$–$C_{20}$ acyl halide.

15. The process of claim 1 wherein the reagent is an alkylating agent selected from the group consisting of $C_2$–$C_{20}$ olefins, paraffins and compounds having the formula $R_2$ - X wherein $R_2$ is an alkyl, cycloalkyl, arylcycloalkyl or aryl alkyl radical and X is a halogen or hydroxyl group.

16. The process of claim 15 wherein the reaction is effected in the presence of an alkylation catalyst.

17. The process of claim 15 wherein the alkylating agent is a $C_2$–$C_8$ olefin.

18. The process of claim 15 wherein the alkylating agent is a $C_2$–$C_8$ alkyl halide.

* * * * *